US010129631B2

(12) United States Patent
Jetter

(10) Patent No.: US 10,129,631 B2
(45) Date of Patent: Nov. 13, 2018

(54) SYSTEM AND METHOD FOR OPEN TO CLOSED-BACK HEADSET AUDIO COMPENSATION

(71) Applicant: LOGITECH EUROPE, S.A., Lausanne (CH)

(72) Inventor: Robert Jetter, Pleasanton, CA (US)

(73) Assignee: LOGITECH EUROPE, S.A., Lausanne (CH)

( * ) Notice: Subject to any disclaimer, the term of this patent is extended or adjusted under 35 U.S.C. 154(b) by 130 days.

(21) Appl. No.: 15/246,026

(22) Filed: Aug. 24, 2016

(65) Prior Publication Data

US 2017/0064435 A1 Mar. 2, 2017

Related U.S. Application Data

(60) Provisional application No. 62/210,380, filed on Aug. 26, 2015.

(51) Int. Cl.

| | |
|---|---|
| ***H04R 1/10*** | (2006.01) |
| ***H04R 3/04*** | (2006.01) |
| ***H04R 5/033*** | (2006.01) |
| ***H04R 1/08*** | (2006.01) |
| *H04R 5/02* | (2006.01) |

(52) U.S. Cl.

CPC ..... *H04R 1/1066* (2013.01); *H04R 1/08* (2013.01); *H04R 1/1008* (2013.01); *H04R 1/1041* (2013.01); *H04R 3/04* (2013.01); *H04R 5/033* (2013.01); *H04R 5/02* (2013.01); *H04R 2201/107* (2013.01); *H04R 2460/11* (2013.01)

(58) Field of Classification Search

CPC .. H04R 1/1008; H04R 1/1016; H04R 1/1041; H04R 1/1058; H04R 1/1066; H04R 1/1083; H04R 1/2807; H04R 3/04; H04R 5/033; H04R 5/04; H04R 2201/105; H04R 2201/107; H04R 5/02; H04R 2460/11

USPC ... 381/309, 72, 74, 370, 371, 372, 373, 374; 181/129, 130; 379/430

See application file for complete search history.

(56) References Cited

U.S. PATENT DOCUMENTS

| | | | | |
|---|---|---|---|---|
| 2,782,423 | A | 2/1957 | Eli et al. | 2/209 |
| 4,041,256 | A | 8/1977 | Ohta et al. | |
| 4,270,025 | A | 5/1981 | Alsup et al. | 179/15.55 R |

(Continued)

FOREIGN PATENT DOCUMENTS

| | | | |
|---|---|---|---|
| EP | 1 638 364 | 3/2006 | H04R 1/10 |
| WO | WO 03/103255 | 12/2003 | H04M 1/05 |

OTHER PUBLICATIONS

Fibush, David K., "Integrating Digital Audio Into the Serial Digital Video Signal," SMPTE Journal, pp. 574-579, Sep. 1994.

(Continued)

*Primary Examiner* — Huyen D Le

(74) *Attorney, Agent, or Firm* — Patterson & Sheridan, LLP

(57) ABSTRACT

A configurable headset includes a stock open-back configuration, wherein an audio profile for the headset in the stock open-back configuration is optimized. When the stock open-back configuration is physically modified to a closed-back configuration, the audio profile degrades, but is manually or automatically improved through selection of a pre-programmed compensated audio profile via an audio profile controller in communication with the configurable headset.

22 Claims, 12 Drawing Sheets

(56) References Cited

U.S. PATENT DOCUMENTS

| | | | | |
|---|---|---|---|---|
| 4,302,635 | A | 11/1981 | Jacobsen et al. | 381/371 |
| 4,472,607 | A | 9/1984 | Houng | 181/18 |
| 4,554,993 | A | 11/1985 | Houng | 181/130 |
| 4,588,868 | A | 5/1986 | Bertagna et al. | 381/382 |
| 4,829,571 | A | 5/1989 | Kakiuchi et al. | 381/309 |
| 4,965,836 | A | 10/1990 | Andre et al. | 381/370 |
| 5,018,599 | A | 5/1991 | Dohl et al. | 181/129 |
| 5,035,005 | A | 7/1991 | Hung | 2/209 |
| 5,579,430 | A | 11/1996 | Grill et al. | 395/2.12 |
| 5,685,775 | A | 11/1997 | Bakoglu et al. | 463/41 |
| 5,793,878 | A | 8/1998 | Chang | 381/370 |
| 6,016,347 | A | 1/2000 | Magnasco et al. | 369/430 |
| 6,069,964 | A | 5/2000 | Yang | 381/374 |
| 6,097,809 | A | 8/2000 | Lucey et al. | 379/430 |
| 6,183,367 | B1 | 2/2001 | Kaji et al. | 463/42 |
| 6,241,612 | B1 | 6/2001 | Heredia | 463/42 |
| 6,295,366 | B1 | 9/2001 | Haller et al. | 381/374 |
| 6,466,681 | B1 | 10/2002 | Siska, Jr. et al. | 381/372 |
| 6,599,194 | B1 | 7/2003 | Smith et al. | 463/30 |
| 6,618,714 | B1 | 9/2003 | Abrahams | 706/45 |
| 6,658,130 | B2 | 12/2003 | Huang | 381/384 |
| 6,731,771 | B2 | 5/2004 | Cottrell | 381/371 |
| 6,775,390 | B1 | 8/2004 | Schmidt et al. | 381/371 |
| 6,868,164 | B2 | 3/2005 | Ito et al. | 381/370 |
| 7,082,393 | B2 | 7/2006 | Lahr | 704/233 |
| 7,090,582 | B2 | 8/2006 | Danieli et al. | 463/35 |
| 7,181,037 | B2 | 2/2007 | Birch | 381/375 |
| 7,371,175 | B2 | 5/2008 | Gilboy et al. | 463/35 |
| 7,458,894 | B2 | 12/2008 | Danieli et al. | 463/42 |
| 8,139,807 | B2 | 3/2012 | Riess et al. | 381/375 |
| 8,335,335 | B2 | 12/2012 | Reiss et al. | 381/375 |
| 8,491,386 | B2 | 7/2013 | Reiss et al. | 463/35 |
| 8,602,892 | B1 | 12/2013 | Reiss et al. | 463/35 |
| 8,767,995 | B2 * | 7/2014 | Hwang | H04R 1/1091 381/370 |
| 8,837,765 | B2 * | 9/2014 | Lin | H04R 1/2807 381/371 |
| 1,127,161 | A1 | 2/2015 | Baldwin | 381/379 |
| 2001/0044277 | A1 | 11/2001 | Kremsl et al. | 455/66 |
| 2002/0110246 | A1 | 8/2002 | Gosior et al. | 381/2 |
| 2002/0131616 | A1 | 9/2002 | Bronnikov et al. | 381/370 |
| 2002/0196960 | A1 | 12/2002 | Pham et al. | 381/375 |
| 2004/0132509 | A1 | 7/2004 | Glezerman | 455/575.2 |
| 2004/0198436 | A1 | 10/2004 | Alden | 455/556.1 |
| 2004/0213427 | A1 | 10/2004 | Yoon | 381/370 |
| 2005/0003892 | A1 | 1/2005 | Cheng et al. | 463/35 |
| 2005/0007500 | A1 | 1/2005 | Lin et al. | 348/790 |
| 2005/0159833 | A1 | 7/2005 | Giaimo et al. | 700/94 |
| 2005/0181872 | A1 | 8/2005 | Acharya et al. | 463/35 |
| 2006/0062417 | A1 | 3/2006 | Tachikawa | 381/378 |
| 2006/0084504 | A1 | 4/2006 | Chan et al. | 463/39 |
| 2006/0256992 | A1 | 11/2006 | Liao | 381/371 |
| 2007/0004472 | A1 | 1/2007 | Gitzinger | 455/575.2 |
| 2007/0064969 | A1 | 3/2007 | Chou | 381/381 |
| 2007/0093279 | A1 | 4/2007 | Janik | 455/569.1 |
| 2007/0183616 | A1 | 8/2007 | Wahl et al. | 381/370 |
| 2007/0261153 | A1 | 11/2007 | Wise et al. | 2/423 |
| 2008/0085676 | A1 | 4/2008 | Huang | 455/3.06 |
| 2008/0152160 | A1 | 6/2008 | Chew et al. | 381/71.6 |
| 2008/0165989 | A1 | 7/2008 | Seil et al. | 381/119 |
| 2008/0311986 | A1 | 12/2008 | Reiss et al. | 463/35 |
| 2009/0252355 | A1 | 10/2009 | Mao | 381/309 |
| 2010/0285750 | A1 | 11/2010 | Simonelic | 455/41.3 |
| 2011/0261971 | A1 | 10/2011 | Miseki et al. | |
| 2012/0087511 | A1 | 4/2012 | Lumsden et al. | |
| 2012/0140961 | A1 | 6/2012 | Reiss et al. | |
| 2013/0288795 | A1 | 10/2013 | Reiss et al. | 463/35 |
| 2015/0222980 | A1 | 8/2015 | Pizzaro et al. | |

OTHER PUBLICATIONS

Press Release, "Xbox Turns Up the Volume on the Future of Video Games" [online], May 20, 2001 [retrieved on Apr. 8, 2010], 2 pp., Retrieved from the Internet: http://www.microsoft.com/press/2002/may02/05-20-e3brie . . . .

Turtle Beach, "New Gaming Headphones Provide Amplification of Game Audio and Xbox Live Chat" [online], Oct. 8, 2006 [retrieved on Apr. 8, 2010], 1 p., Retrieved from the Internet: http://www.turtlebeach.com/releases/20061008/Ear-Force-X1-Xbo . . . .

Turtle Beach, "First Wireless Headphone for Xbox 360 with Independent Volume Control of Amplified Chat and Game Audio" [online], Aug. 22, 2007 [retrieved on Apr. 8, 2010], 2 pp., Retrieved from the Internet: http://www.turtlebeach.com/releases/20070822/Turtle-Beach-Annou . . . .

International Search Report and Written Opinion for Application Serial No. PCT/US2010/058629, dated Jan. 28, 2011, 8 pp.

"Zehn Kopfhorer-Mikrofon-Sets im Vergleich," Computer Bild, Oct. 17, 2007, http://www.computerbild.de/aritkel/cbs-Tests-Hardware-Zehn-Kopfhoerer-Mikrofon-Sets-im-Vergleich-1873070.htm [retrieved Mar. 2, 2009], pp. 2-12.

International Search Report, dated Jul. 15, 2009, issued in corresponding PCT/US2008/087280, filed Dec. 17, 2008.

Gerry Block, "Turtle Beach X2 Wireless Headset Review," May 3, 2006, IGN, http://www.ign.com/articles/2006/05/04/turtle-beach-x2-wireless-headset-review.

Supplementary European Search Report and European Search Opinion for European Application No. EP 10 83 5092, dated Feb. 25, 2014, 14 pp.

European Search report for European Application No. 16186049.9 dated Jan. 26, 2017, 7 pages.

* cited by examiner

SYSTEM AND METHOD FOR OPEN TO CLOSED-BACK HEADSET AUDIO COMPENSATION

CROSS-REFERENCE TO RELATED APPLICATIONS

The present application claims of the benefit of priority to similar titled U.S. Provisional Patent Application No. 62/210,380 filed Aug. 26, 2017 which is incorporated herein by reference in its entirety. This application incorporates herein by reference the following co-owned patents and patent applications: U.S. Pat. Nos. 8,139,807; 8,335,335; 8,491,386; 8,602,892; and Ser. No. 13/926,015.

BACKGROUND OF THE EMBODIMENTS

Field of the Embodiments

The embodiments relate generally to optimizing audio through audio headsets. More particularly, the embodiments related to optimizing audio to counter the negative effects on audio which may result from changes in the physical configuration of the audio headset, e.g., open to closed configuration.

Description of the Related Art

Conventional headphones are formed from two loudspeakers, shrunken in size, which are assembled together by a headband and worn over the ears of the wearer. Heavy and large in the past, headphones today feature modem designs that are lighter and smaller. Additionally, headphone designs have been modified in accordance with intended use thereof and may include open-back and closed-back configurations.

Further, the evolution of gaming has created the need for more advanced audio and communication solutions. A gamer wishing to utilize a personal headset during game play wants a better audio experience without the need to be physically tethered to a gaming console. Moreover, serious gamers require the ability to converse with other gamers at remote locations or in tournament gaming situations and listen to game audio simultaneously through the use of a headset.

The conventional open-back wired headphone option which is optimal for many listening situations may not be practical for a gamer wishing to operate a game console controller from a distance farther than the wired headphone may reach or for a gamer who wishes to move around a room unrestrained. Moreover, many gamers already own a preferred wired headset, and these individuals either may not be able to afford, or may not wish to purchase, a different wireless headset for each gaming system at great personal expense. One solution developed by the present applicant, Astro Gaming, Inc., to facilitate use of generic open-back wired headphones in wireless situations and with different consoles includes the use of a MixAmp™ with the open-back wired headphones which can communicate in a wired or wireless fashion with the gaming console and/or game controller to facilitate game and network chat audio communication to/from the headset. A detailed description of the various headset and MixAmp™ configurations is found in U.S. Pat. No. 8,491,386 (Systems and methods for remotely mixing multiple audio signals) and U.S. patent application Ser. No. 13/926,015 (Wireless Game/Audio System and Method), the contents of which are incorporated herein by reference in their entirety.

But while conventional open-back wired (or wireless) headphones (with or without use of a MixAmp™) may be useful and even optimal for many audio situations, in a particularly noisy environment, such as game tournaments, the background noise of, e.g., other teams and spectators, etc., can simply overwhelm the open-back headphones. In these situations, closed-back headphones may be contemplated. Such closed-back headphones are either unique to a particular system or require additional components, such as a MixAmp™, to massage the incoming audio signals and compensate for the distortion caused by shutting out the air to the internal mechanics, i.e., diaphragms, of the headphones. Such closed-back headphones are not optimized for use outside of the unique system and environment for which they are specially designed. Consequently, a user may need to purchase multiple types of headsets for each different audio environment.

Accordingly, there is a need in the art for a system that facilitates use of stock open-back headsets in audio environments ranging from wired, single output listening with minimal background noise (e.g., home television or computer listening) to multiple output (game and chat) wired or wireless listening with high background noise (e.g., tournament gaming environment).

SUMMARY OF THE EMBODIMENTS

In a first exemplary embodiment, an audio compensation system comprises: a convertible headset including a left earphone configured to convert electrical energy into sound waves; a right earphone configured to convert electrical energy into sound waves; a first removable and interchangeable noise plate configured to selectively attach to one of the right and left earphones; a second removable and interchangeable noise plate configured to selectively attach to the other of the right and left earphones; a first removable air-tight pad inserted between a first of the left and right earphones and the first removable and interchangeable noise plate when the convertible headset is in a closed configuration; a second removable air-tight pad inserted between a second of the left and right earphones and the second removable and interchangeable noise plate when the convertible headset is in a closed configuration; wherein both the left earphone and the right earphone include components to facilitate mechanical and audible coupling with a removable microphone with or without one or both of the first and second noise plates and first and second removable air tight pads attached thereto, the components including a receiver component for receiving the connector portion of the removable microphone therein directly or after the connector portion passes through the aperture when the first noise plate is attached to one of the right and left earphones; wherein the first and second noise plates and first and second removable air tight pads insulate a user of the headset from noise produced externally when one or both are attached to the convertible headset in the closed configuration; and an audio profile controller connected to the convertible headset and one or more audio sources, the audio profile controller including one or more audio equalizer profiles programmed therein to compensate for negative audio effects resulting from the closed configuration of the convertible headset.

In a second exemplary embodiment a convertible headset comprises: an assembly of parts configured to convert electrical energy into sound waves, the assembly including earphones and removable and interchangeable components for physically altering the configurable headset from an open to a closed configuration, wherein altering the convertible headset from an open to closed configuration produces negative audio effects for a user of the convertible headset; the assembly of parts further including an audio profile controller connected to the convertible headset and one or more audio sources, the audio profile controller including one or more audio equalizer profiles programmed therein to compensate for the negative audio effects.

In a third exemplary embodiment a convertible headset for facilitating communication from and to a user of the headset during a multiplayer game and optimizing game audio quality comprises: a left earphone including left audio circuitry, a removable left noise plate and a removable left air-tight pad; a right earphone including right audio circuitry, a removable right noise plate and a removable left air-tight pad; a microphone attached to one of the left and right earphones for generating internal communications; wherein the left noise plate, left air-tight pad, the right noise plate and the right air-tight pad isolate internal communications between the user and other players in the multiplayer game by insulating the user of the headset from external communications when the left noise plate, left air-tight pad, the right noise plate and the right air-tight pad are attached to the headset in a closed headset configuration; further wherein the user can remove the left noise plate, left air-tight pad, the right noise plate and the right air-tight pad in order to facilitate receipt of internal and external communications in an open headset configuration; and an audio profile controller connected to the convertible headset and receiving therein one or more audio signals, including a game audio signal, the audio profile controller including one or more audio equalizer profiles programmed therein to compensate for negative audio effects experiences by the user resulting from the closed headset configuration of the convertible headset.

The foregoing aspects and many of the attendant advantages of the embodiments herein will become more readily appreciated as the same become better understood by reference to the following detailed description, when taken in conjunction with the accompanying drawings, wherein.

DETAILED DESCRIPTION

In competitive gaming environments, modern headsets are connected to an audio exchange with boom assemblies that support microphones, easing communications among teammates without the need to shout to be heard. In various embodiments herein, earphones, which convert electrical energy into sound waves, are designed with an externally facing air-permeable grille and ear-facing air-permeable cloth or foam pads in a first open-back configuration. The headset in this first open-back configuration is optimized for use in nearly all listening environments and is usable with a MixAmp™ to facilitate wireless headset use with different gaming consoles and to balance game audio and chat volume to the headset.

In a second configuration, the open-back headset is physically modified with attachable components as discussed further herein to essentially produce a closed-back headset, but audio distortion that is necessarily produced by the restricted air flow to the headphones is compensated for the MixAmp™ prior to the audio signals reaching the headset. The following is instructive.

Figure 1A:
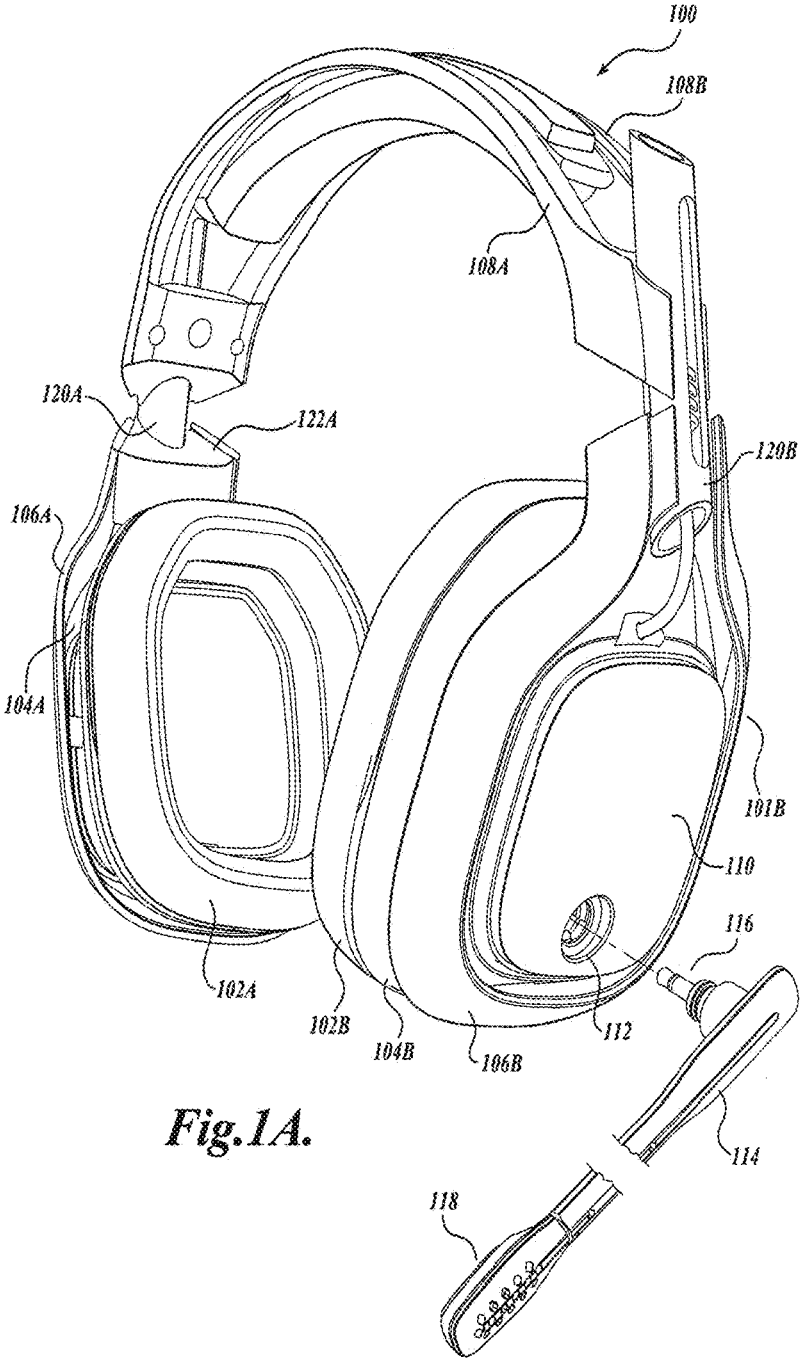
FIG. 1A is a perspective diagram illustrating an exemplary pair of earphones including an exemplary removable boom assembly.
Figure 1B:
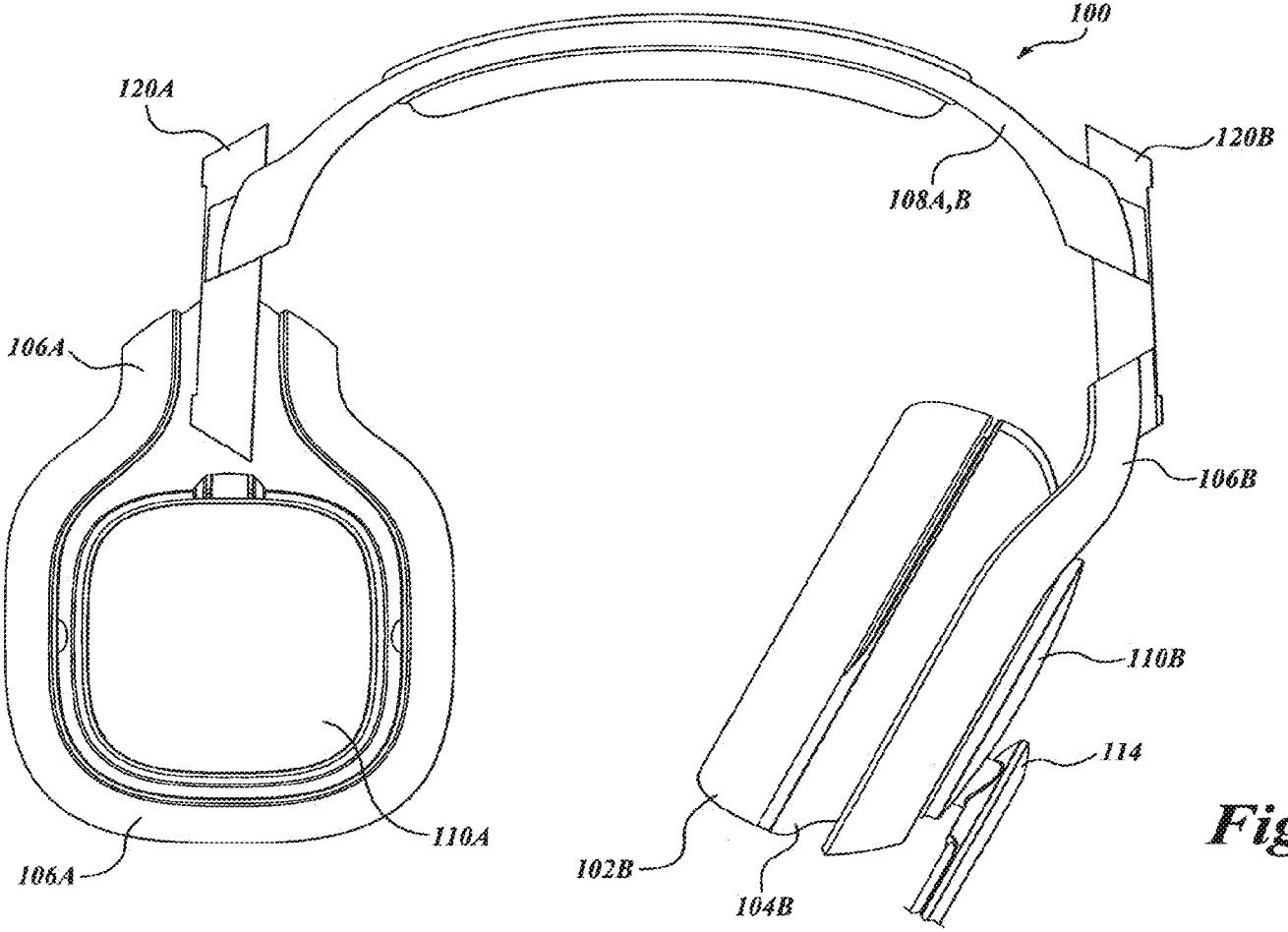
FIG. 1B is a perspective diagram illustrating an exemplary pair of earphones including an exemplary removable boom assembly.

FIGS. 1A, 1B illustrate a headset 100 that comprises a pair of earphones 101*a*, 101*b* held over a gamer's ears by a pair of bands 108*a*, 108*b* worn over the head. Each earphone 101*a*, 101*b* includes a removable pad 102*a*, 102*b*, which envelops the ear by enclosing it completely. Each earphone 101*a*, 101*b* includes a frame 106*a*, 106*b* that is mechanically coupled to a shell 104*a*, 104*b*. The shell 104*a*, 104*b* is further mechanically coupled to the pad 102*a*, 102*b* to enclose assembled parts residing between the pad 102*a*, 102*b* and the shell 104*a*, 104*b*, as well as providing rigidity to the structure of each earphone 101*a*, 101*b*. In the open-back configuration, the removable pads 102*a*, 102*b* are formed of cloth, foam or other air-permeable material and are attachable/detachable to the earphones by multiple magnetic members similar to those discussed below with respect to the optional tags or noise plates (not shown). Although FIGS. 1A, 1B illustrate the headset 100 with the tag or noise plates 110 attached thereto, these are not required for operation.

Further, as discussed below the removable tags or noise plates 110 may be provided in two different structures. In a first structure, the tags 110 are plastic or composite plates, having multiple magnetic members 110A-110D for attaching the tags 110 to a gasket 202 (see FIGS. 2, 3 and 7A-7G). In this first structure, air is still able to permeate through the headphones through the air gap that remains between the plastic plate and the gasket which is approximately equal to the length of the multiple magnetic members 110A-110D (see FIGS. 7C, 7D, 7G).

In a second structure, removable noise plates 110' include an air tight gasket seal 120 to seal the air gap from the first structure. Accordingly, when using the headset in the closed-back configuration, the user swaps out the tags 110 or the noise plates 110'. The noise plates 110' provide insulation against distracting noise that is produced in a competitive environment, such as during gaming tournaments. The tags or noise plates 110 or 110' are easily removed by exerting a force greater than the magnetic coupling that fastens them to the earphone 101*a*, 101*b*.

The tags or noise plates 110 or 110' may include in one or both (left/right) an aperture 112 that guides a jack 116 of a boom assembly 114 to mate with a female port (not shown) of the earphone 101*a*, 101*b*. When connected, the wearer of the headset 100 may audibly communicate via utterances that are received by the microphone screen 118 for transmission to audio circuitry components (not shown).

The earphones 101*a*, 101*b* are mechanically coupled to the band 108*a*, 108*b* via hollowed cylinders 120*a*, 120*b*. Protected by these cylinders 120*a*, 120*b* are audio wires that transmit audio communication to the earphones 101*a*, 101*b*. These audio wires also receive audio communication received from the boom assembly 114 for transmission to other audio processing circuitry (not shown). FIG. 1B illustrates that the earphone 101*a* can be rotated about 90 degrees. The earphone 101*b* can be similarly rotated. When the wearer of the headset 100 rests the headset 100 on his neck, both earphones 101*a*, 101*b* may be rotated so that the pads 102*a*, 102*b* engage his chest, and in this manner, add comfort as well as exposing art work, advertisements, insignia, trademarks, designs, etc., on the tags or noise plates 110 or 110'.

Figure 2:
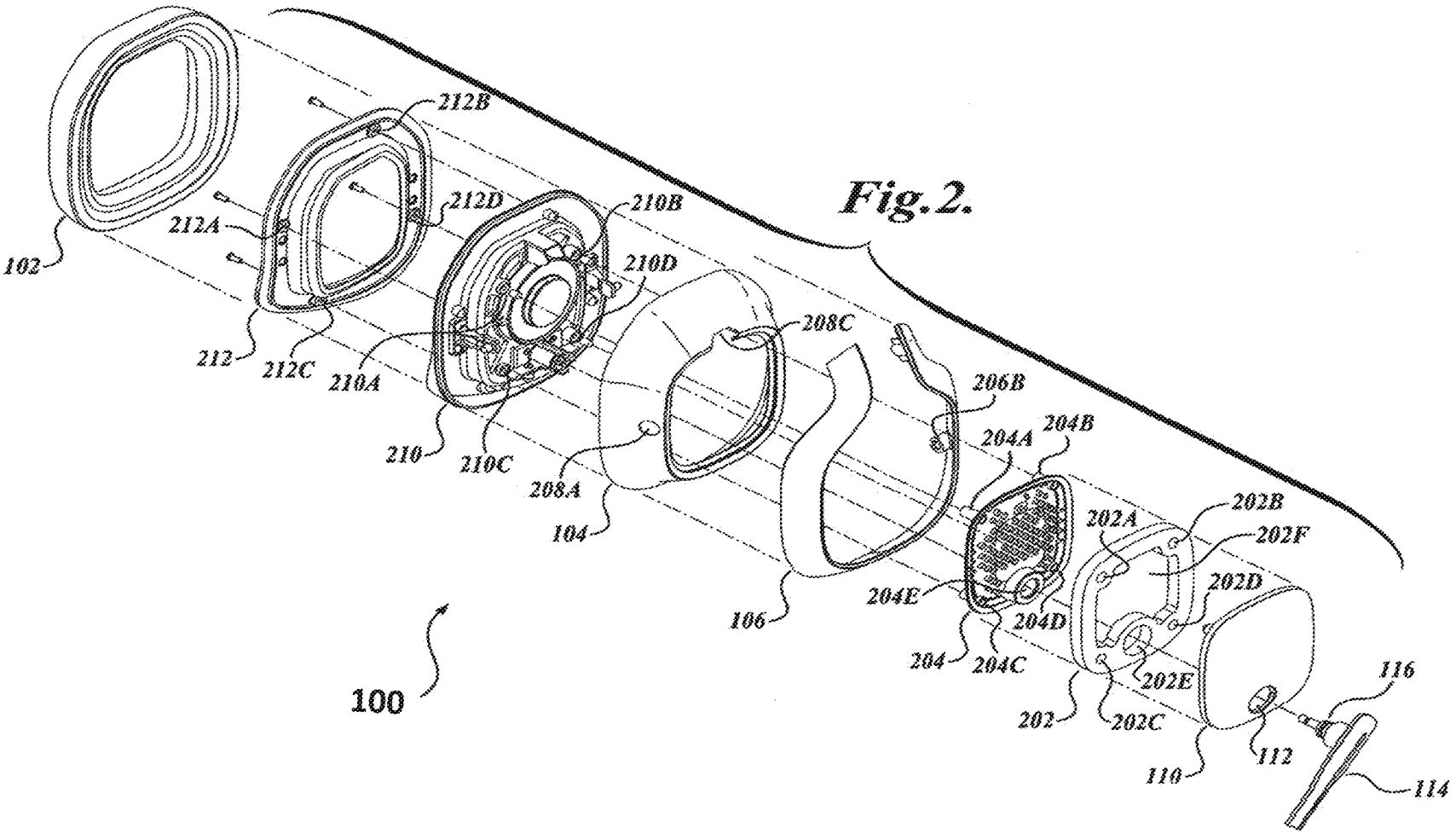
FIG. 2 is an exploded perspective diagram of an exemplary earphone.
Figure 3:
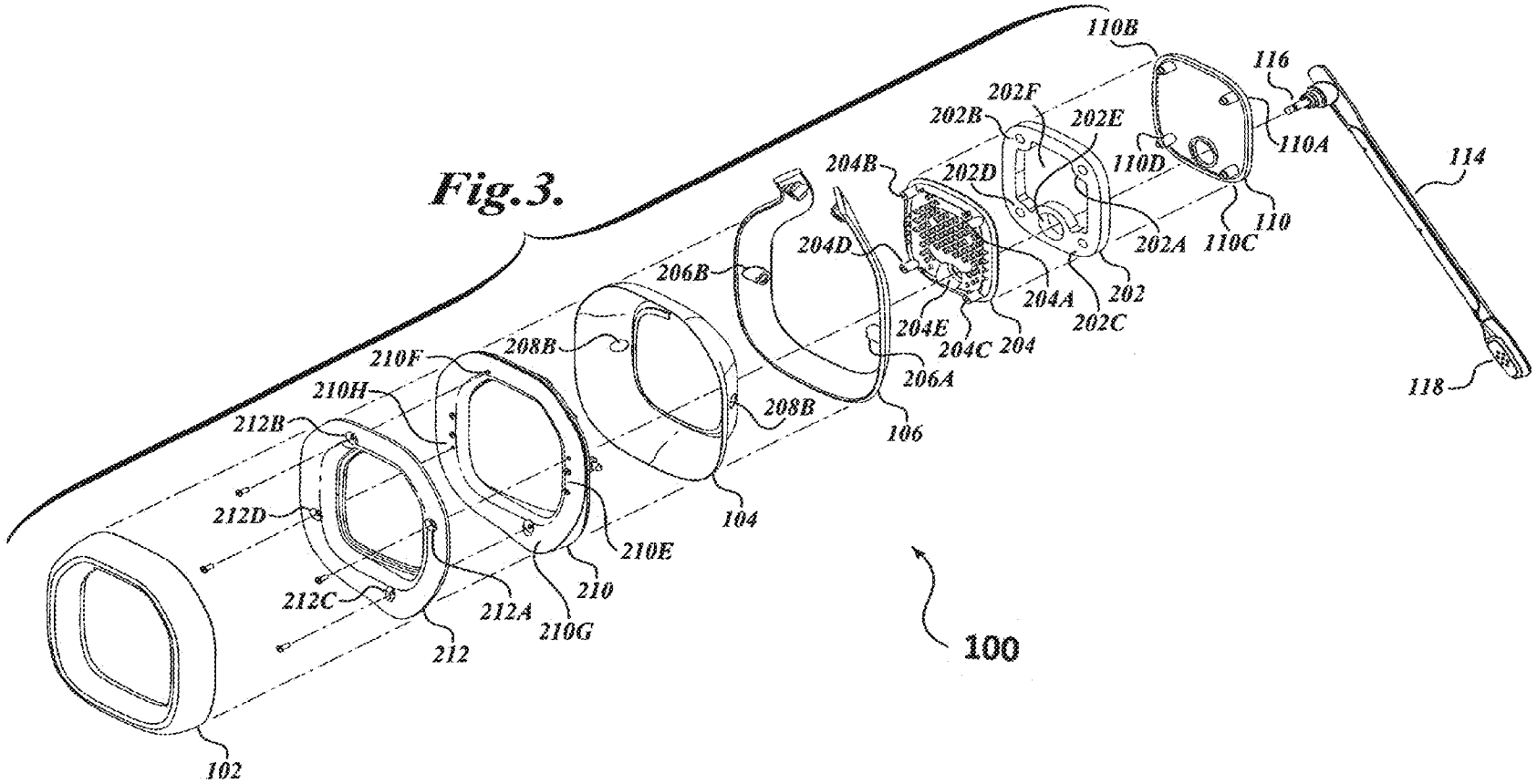
FIG. 3 is an exploded perspective view of an exemplary earphone.

FIGS. 2-3 illustrate an exemplary earphone 100 presented in an exploded perspective view. The earphone 100 includes the tags or noise plates 110 or 110' (shown as tag 110). The tag 110 as shown is generally rectangular in shape and includes an aperture 112 for guiding jack 116 to audio circuitry (not shown) to transmit audio information received by the boom assembly 114. The earphone 100 includes a gasket 202 having an annular shape for defining an opening 202*f*. Multiple holes 202*a*-202*d* are provided near the corners of the gasket 202. These holes allow magnetic members 210*a*-210*d* to magnetically couple the tags or noise plates 110 or 110' to other assembled parts of the earphone 100. The gasket 202 includes an aperture 202*e* to cooperatively communicate with the aperture 112 for guiding jack 116 to mate with audio circuitry (not shown) of the earphone 100.

The earphone 100 includes a grille 204 that is characterized by perforation forming a screen through which ambient sound may readily enter the earphone 100 in the open-back configuration when such ambient sound is not attenuated or eliminated by the noise plate 110'. The grille 204 includes a number of hollowed cylinders 204*a*-204*d* for accommodating a number of magnetic members 210*a*-210*d* to magnetically couple an assembly of the tags or noise plates 110 or 110', the gasket 202, and the grille 204 to the remaining assembled parts of the earphone 100. A hollowed, projected cylinder 204*e* protrudes into the aperture 202*e* of the gasket 202 which terminates at the aperture 112 of the tags or noise plates 110 or 110' to further help guide the jack 116 of the boom assembly 114 to mate with audio circuitry (not shown) of the earphone 100.

The earphone 100 includes a frame 106 characterized by its U-shaped racetrack form. Protruding at an angle from one side of either arm of the U-shaped frame 106 is a hollowed cylinder 206*a*, 206*b* that engages openings 208*a*, 208*b* of the earphone 100 to allow the frame 106 to cradle at various angles, hence adding comfort to the wearer of the earphone 100.

The earphone 100 includes the shell 104 having two open ends. The diameter of a proximal end of the shell 104 tapers gradually to a distal end of the shell 104 to form a neck. Two openings 208*a*, 208*b* on either side of the neck of the shell 104 mate with projected hollowed cylinders 206*a*, 206*b* of the frame 106, thus allowing the frame 106 to cradle against the shell 104. A notch 208*c* located at the distal end of the shell 104 is configured to receive speaker wire for transmitting audio information into the earphone 100.

The earphone 100 includes a bezel 210 on which electrical, electronic, and mechanical parts of a speaker system are assembled. The earphone 100 includes a pliant, annular member 212, whose center opening permits audio sound reproduced by the speaker system housed by the bezel 210 to be projected. Multiple holes 212*a*-212*d* couple the annular member 212 to the bezel 210. The magnetically removable pad 102 is a component of the earphone 100 that envelops the ear of the wearer of the earphone 100. As discussed above, pads 102*a*, 102*b* may be formed of air-permeable materials in the open-back configuration and may be switched out for pads 102*a*', 102*b*' formed of air tight material such as synthetic leather when using the earphone 100 in the closed-bag configuration.

FIG. 3 reveals elements not readily visible with the illustration in FIG. 2. The tag 110 of the earphone 100 includes multiple projected, hollowed cylinders 110*a*-110*c* to accommodate magnetic members 210*a*-210*d* to magnetically couple the tag 110 to other assembled parts of the earphone 101. The boom assembly 114 includes a proximal end that houses jack 116 and a distal end for accommodating a microphone screen 118. The projected, hollowed cylinders 206*a*, 206*b* are more clearly illustrated by the exploded, perspective view of the earphone 100 presented from the back as shown in FIG. 3. As discussed above, tag 110 may be removed and replaced with noise plate 110' as required for the specific closed-back configuration and implementation discussed further herein.

Figure 4:
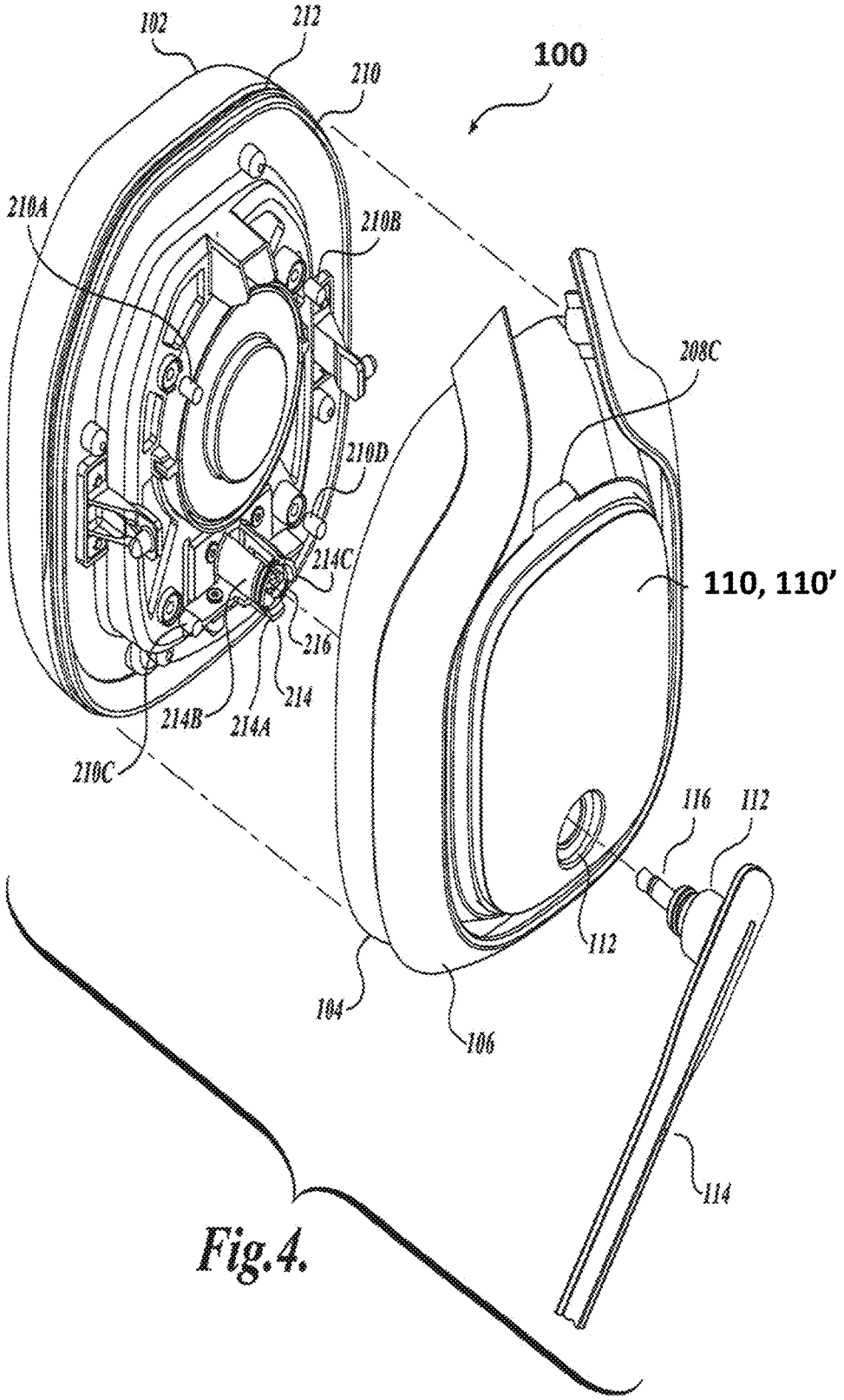
FIG. 4 is an exploded perspective view of an earphone including an exemplary removable boom assembly.

FIG. 4 illustrates a partial assembly of two portions of the earphone 100 in an exploded, perspective presentation. One portion is a fitting of manufactured parts of the earphone 100 that includes an assembly comprising the shell 104, the frame 106, and the tag 110 (or noise plate 110' as the case may be). The notch 208*c* into which earphone wires are guided to assembled parts of the earphone 100 is visible. The aperture 112 of the tags or noise plates 110 or 110' guides the jack 116 of the boom assembly 114 to mechanically and electrically communicate with a clutch 214, which belongs to the other portion of the earphone 100.

The clutch 214 is housed by the bezel 210. The bezel 210 is one part in an assembly of parts, including the pad 102 and the annular member 212, which together comprise another fitting of manufactured parts of the earphone 100. Specifically, the clutch 214 comprises three fingers 214*a*-214*c* that grip a jack collar 402 to seize the boom assembly 114 firmly while allowing the jack 116 to be in electrical communication with the wire form 216 and other assembled parts of the bezel 210 as well as allowing the boom assembly 114 to be coaxially rotated (in the direction where the jack 116 is inserted into the clutch 214). Multiple magnetic members 210*a*-210*d* are shown floating in the illustration to illustrate its fastening function to magnetically couple the bezel 210 to the other parts of the earphone 100.

Figure 5:
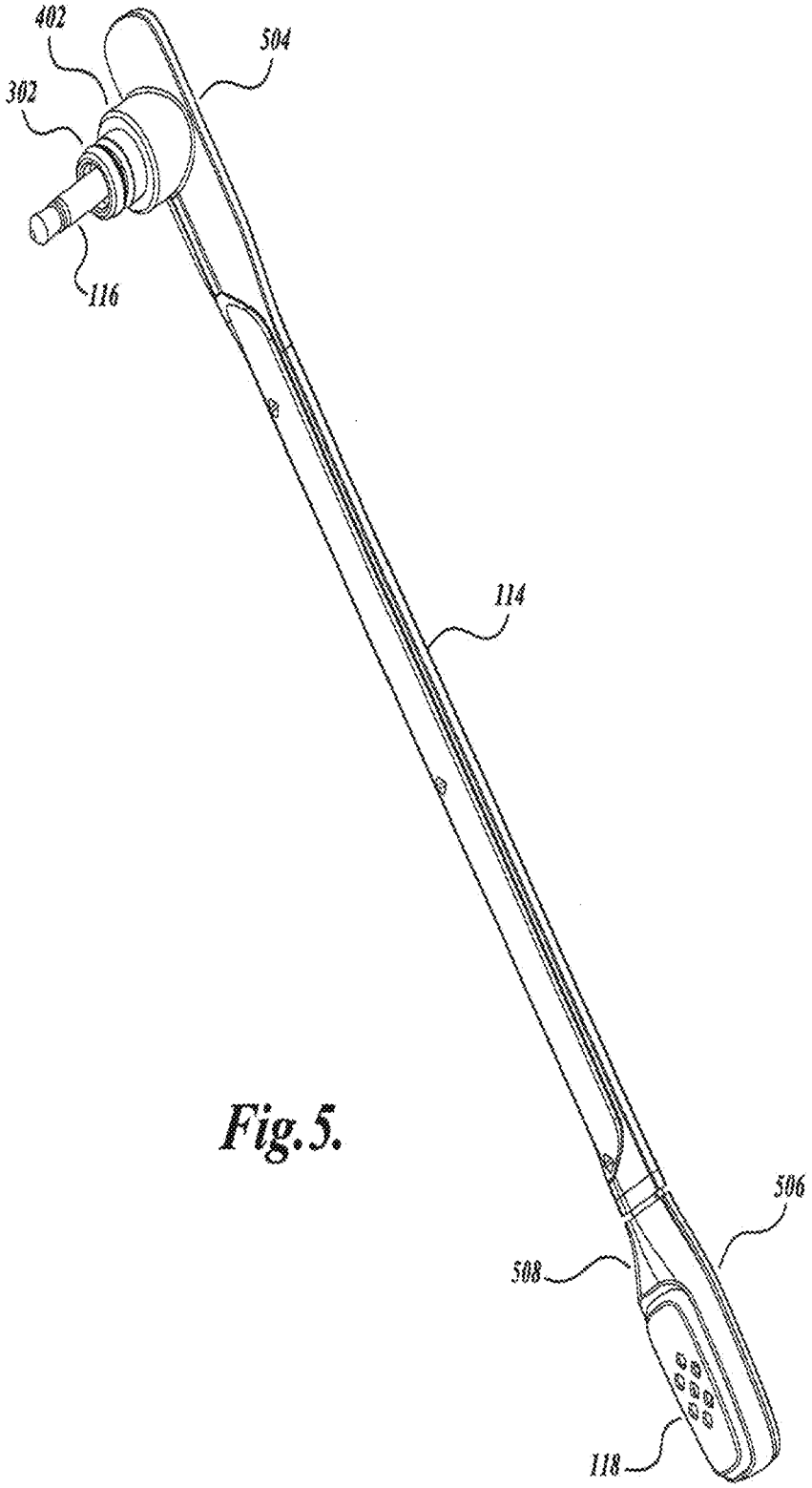
FIG. 5 is a perspective view of a microphone.

FIG. 5 illustrates the boom assembly 114 using a perspective view. The boom assembly 114 includes a boom overmold 504 at a proximal end to house the jack collar 402 that is used to house the jack 116 at its base 502. The jack collar 402 is formed of, partially formed of or includes an outer layer of a gasket-type material, e.g., rubber, so as to form an air-tight seal between the jack collar 402 and the aperture 112 of the tags or noise plates 110 or 110'. Alternatively, the tags or noise plates 110 or 110' may be formed to include a grommet (not shown) at the aperture 112 to engage the jack collar 402 of the boom assembly 114. At the distal end of the boom assembly 114, a microphone receiver is hidden behind the microphone screen 118, which is longitudinally aligned with the front microphone housing 508. Supporting the front microphone housing 508 and the microphone screen 118 is a back 506 of the microphone housing.

Figure 6:
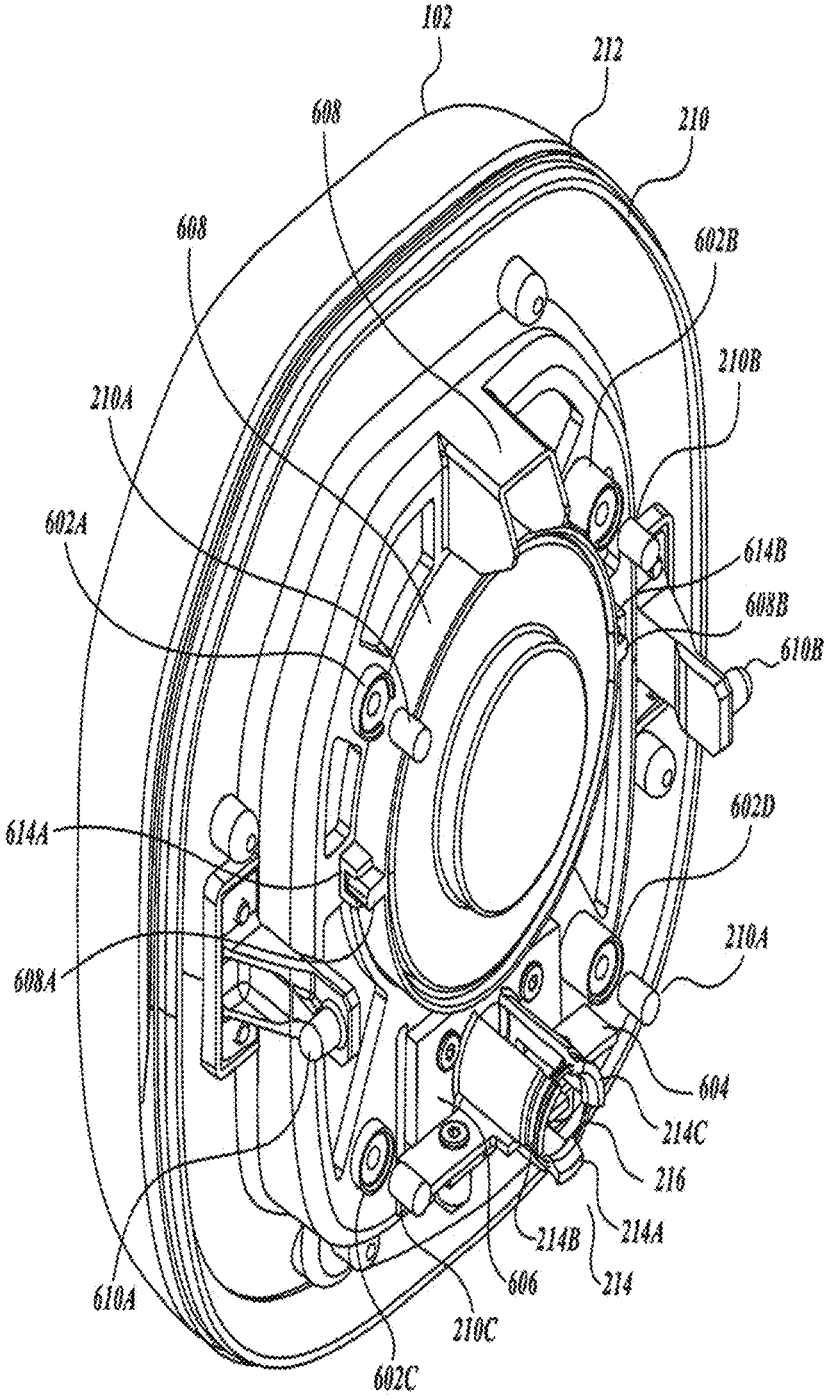
FIG. 6 is a perspective view of an exemplary collection of parts assembled on a bezel so as to change electrical signals into sounds loud enough to be heard by the wearer of an earphone.

FIG. 6 illustrates a collection of parts so assembled to form a portion of the earphone 100. The collection of parts includes the pad 102, the annular member 212, and the bezel 210. The multiple magnetic members 210*a*-210*d* mate with metallic female members 602*a*-602*d* that are characterized as projected, hollowed cylinders, and whose ends include metallic exposures to correspondingly mate with the multiple magnetic members 210*a*-210*d*. The bezel 210 includes the clutch 214, which is formed from three fingers 214*a*-214*c*, perpendicularly projected from a rectangular platform 606 and fastened to the bezel 210 via screws. Wound around the distal ends of the fingers 214*a*-214*c* is a wire form 216 that is configured to mechanically couple with the jack 116 of the boom assembly 114 by providing tension to retain the jack 116. Each finger 214*a*-214*c*, at the distal end, has a groove into which the wire form 216 is set so as to prevent slippage of the wire form 216 from the fingers 214*a*-214*c*. A PC board 604 containing audio circuitry lies on the finger 214*a* and superjacent to the PC board 604 are the fingers 214*b*, 214*c*.

The bezel 210 includes a driver protector 608 that is characterized by its annular shape including two wings 608*a*, 608*b*. The driver protector 608 is fastened to the bezel 210 using a suitable fastening agent, such as glue. The wings of the driver protector 608 mate with two C-shaped members 614*a*-614*b* to prevent slippage of the driver protector 608. Two fingers 610*a*-610*b*, preferably formed from aluminum, are mounted to the bezel 210 at a proximal end while their distal ends are finished with dome-like members that are projected away from each other to mate with holes 208*a*, 208*b*, allowing the frame 106 to cradle against the shell 104, as previously discussed in other figures, such as FIG. 2.

Figure 7A:
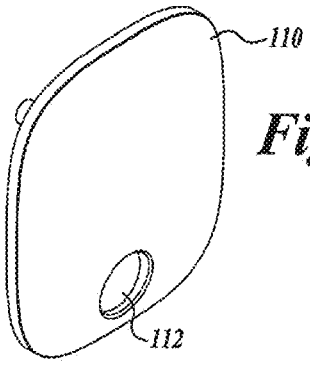
FIG. 7A illustrates an external perspective view of an exemplary earphone tag.
Figure 7B:
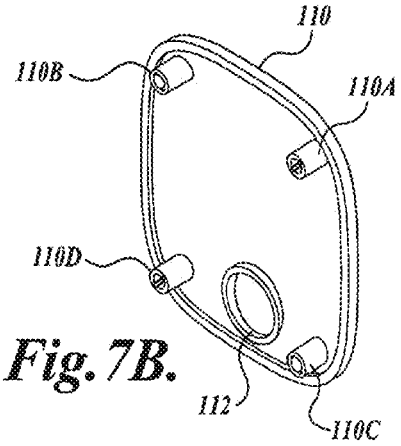
FIG. 7B illustrates an internal perspective view of an exemplary earphone tag.
Figure 7C:
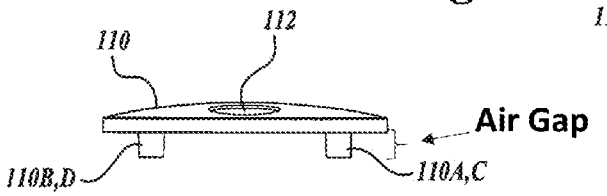
FIG. 7C illustrates a bottom view of an exemplary earphone tag.
Figure 7D:
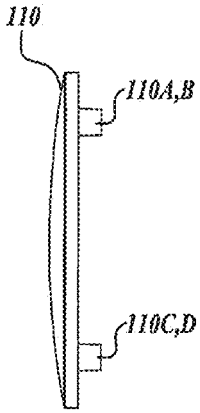
FIG. 7D illustrates a side view of an exemplary earphone tag.
Figure 7E:
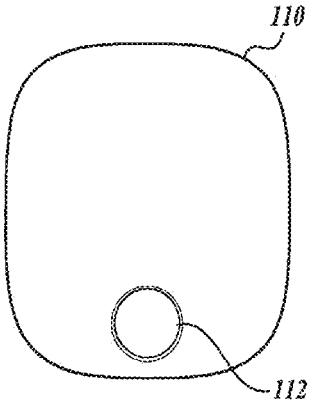
FIG. 7E illustrates a front view of an exemplary earphone tag.
Figure 7F:
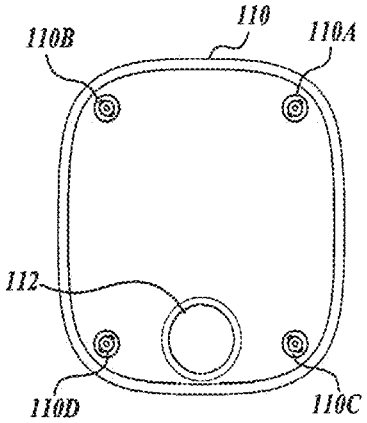
FIG. 7F illustrates a back view of an exemplary earphone tag.
Figure 7G:
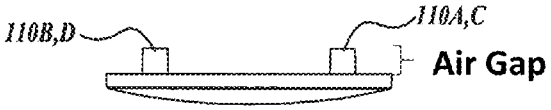
FIG. 7G illustrates a top view of an exemplary earphone tag.
Figure 8A:
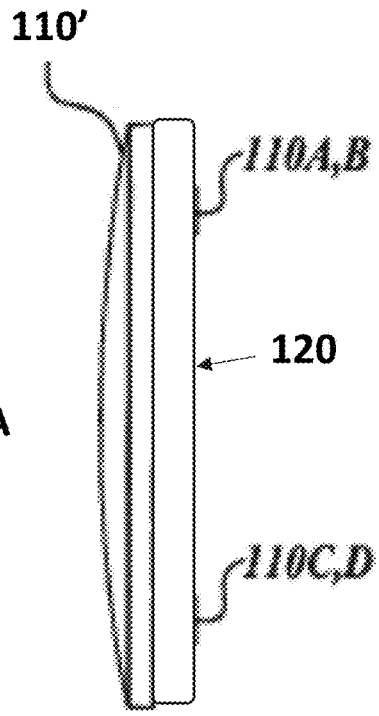
FIGS. 8A and 8B illustrate side views of an exemplary earphone noise plate.
Figure 8B:
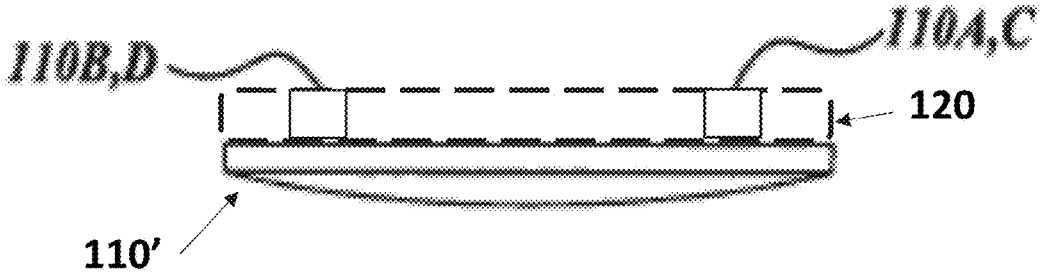

FIGS. 7A-7G illustrate various views of the tag 110. FIG. 7A illustrates a perspective view from the front of the noise plate 110 including a partial view of the projected, hollowed cylinder 110*a*. FIG. 7B illustrates a perspective view from the back of the tag 110. FIG. 7C illustrates a bottom view of the tag 110 in which a slight curvature can be observed across the surface of the tag 110. FIG. 7D illustrates a side view of the tag 110 in which a slight curvature can be observed. FIG. 7E is a front view of the tag 110. FIG. 7F is a back view of the tag 110. FIG. 7G is a top view of the tag 110, whose curvature is seen across the surface. FIGS. 8A, 8B illustrate the alternative noise plate 110' used on the closed-back implementation.

Figure 9:
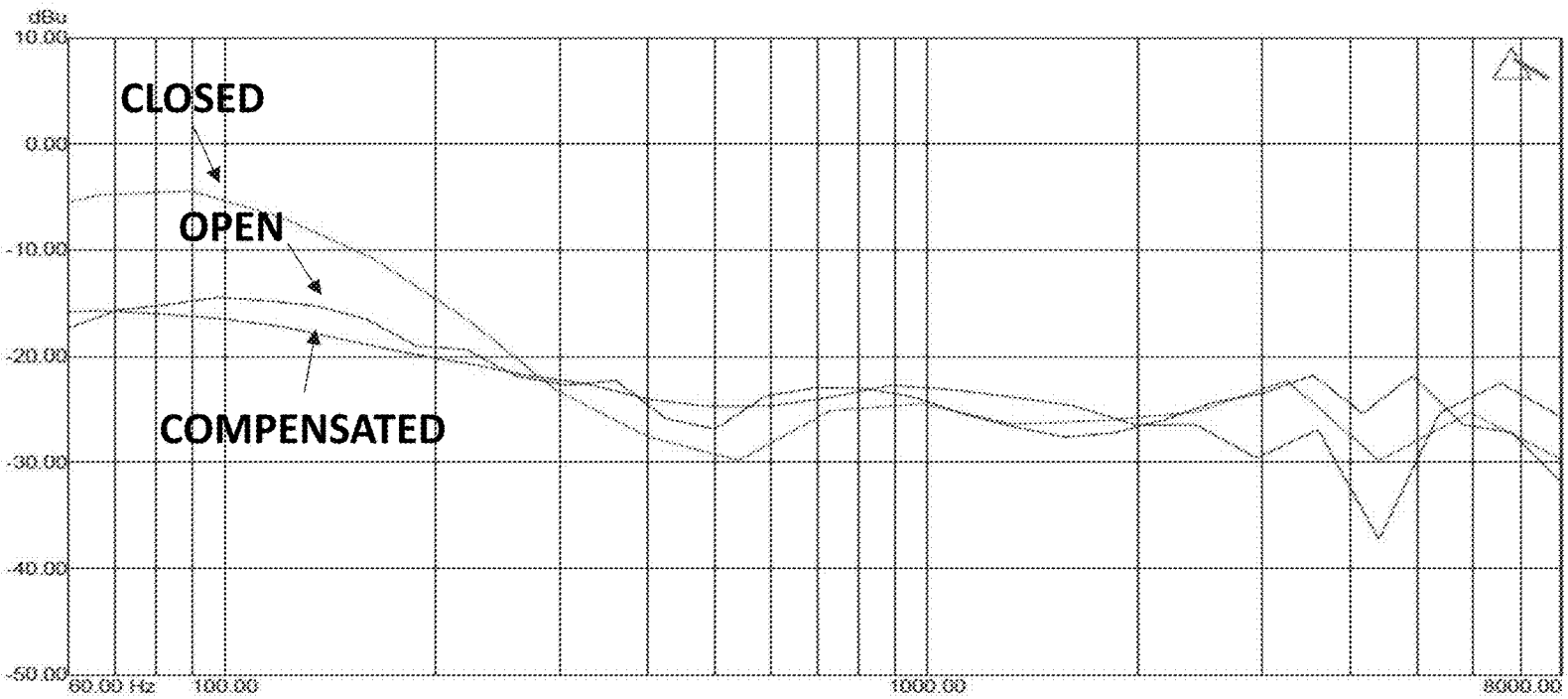
FIG. 9 is a representative graph showing audio profiles of earphones in open, closed and compensated configurations.

As discussed to this point, at base, the headset described herein is in an open-back configuration, wherein the components are designed so as to optimize audio input when the pads 102 and tags 110 are air-permeable. Referring to FIG. 9, an exemplary audio profile for a headset in the stock open-back configuration is optimized as shown (OPEN). When the stock open-back configuration is modified to what is essentially a closed-back configuration by switching out the tags 110 for the noise plates 110' and the cloth pads 102*a*, 102*b* for the air-tight pads 102*a*', 102*b*', the audio profile degrades as shown (CLOSED). But, as discussed further herein, the degraded performance of the now closed-back configuration caused by physical changes to certain components of the stock open-back configuration, can be improved when the headset is used in conjunction with a MixAmp™ or similar audio profile controller (COMPENSATED).

More particularly, as described above, the stock open back configuration (with or without the decorative tags 110) is the preferred configuration for most all listening environments. The open back configuration optimizes sound provided to the user by allowing maximum air to pass, generally unimpeded, through the earphones and to interact with the mechanical diaphragms therein to produce the clearest sound (FIG. 9, OPEN). As described in U.S. Pat. No. 8,491,386 ("'386 Patent"), which is incorporated herein by reference, the present applicant has developed an add-on audio component, e.g., an audio profile controller (MixAmp™), which may be used with headphones such as those described herein to intercept incoming audio signals and perform certain processing thereon. As described in detail in the '386 Patent, the MixAmp™ includes a number of adjustment means, such as but not limited to knobs and/or buttons that are accessible to a user of the audio mixer to allow a user to adjust properties of a blended audio output stream that is transmitted from the audio mixer to a headset of the user.

Figure 10:
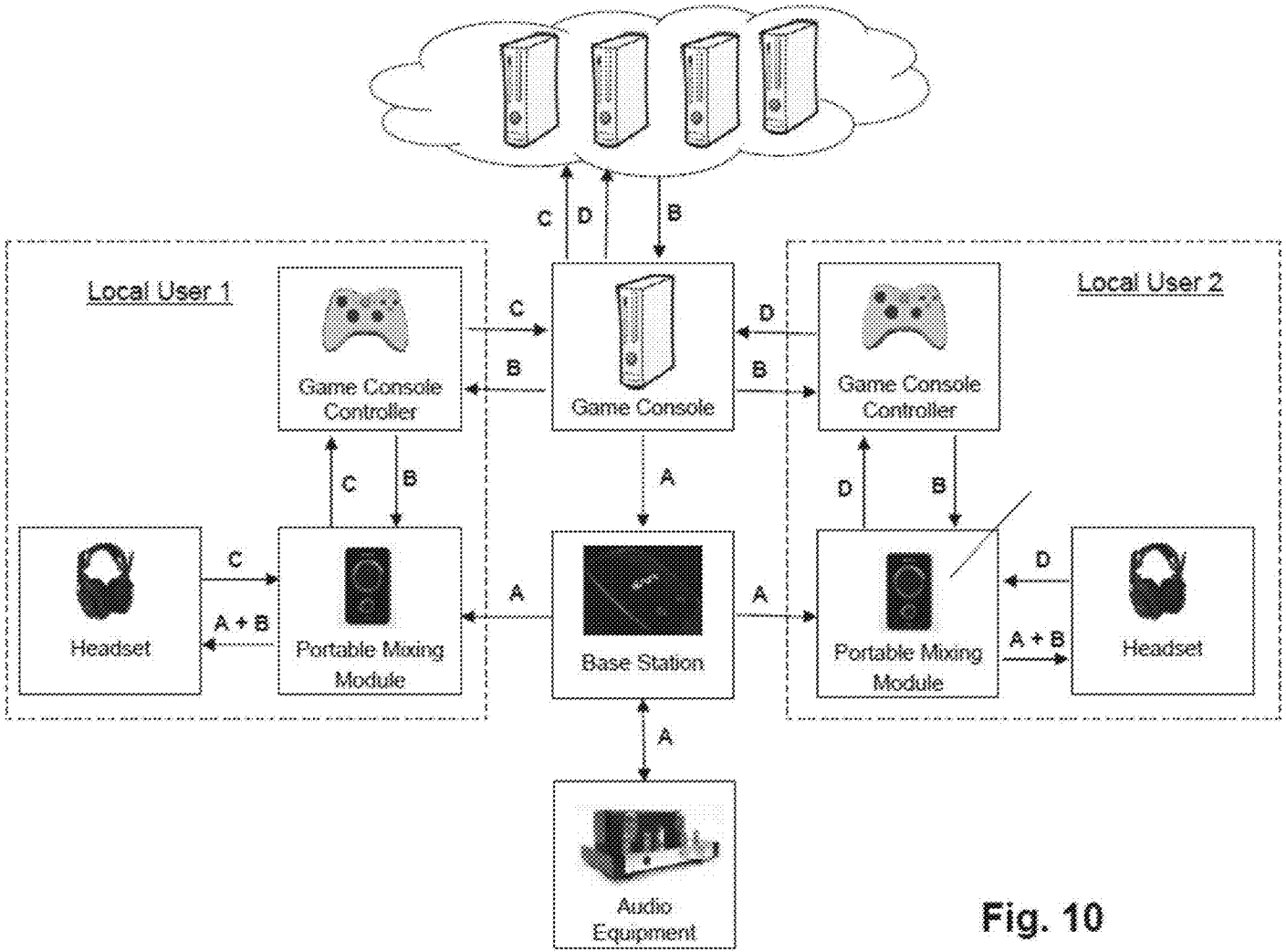
FIG. 10 is an exemplary schematic of a first multi-player which may incorporate the headset and audio profile controller system described herein.
Figure 11:
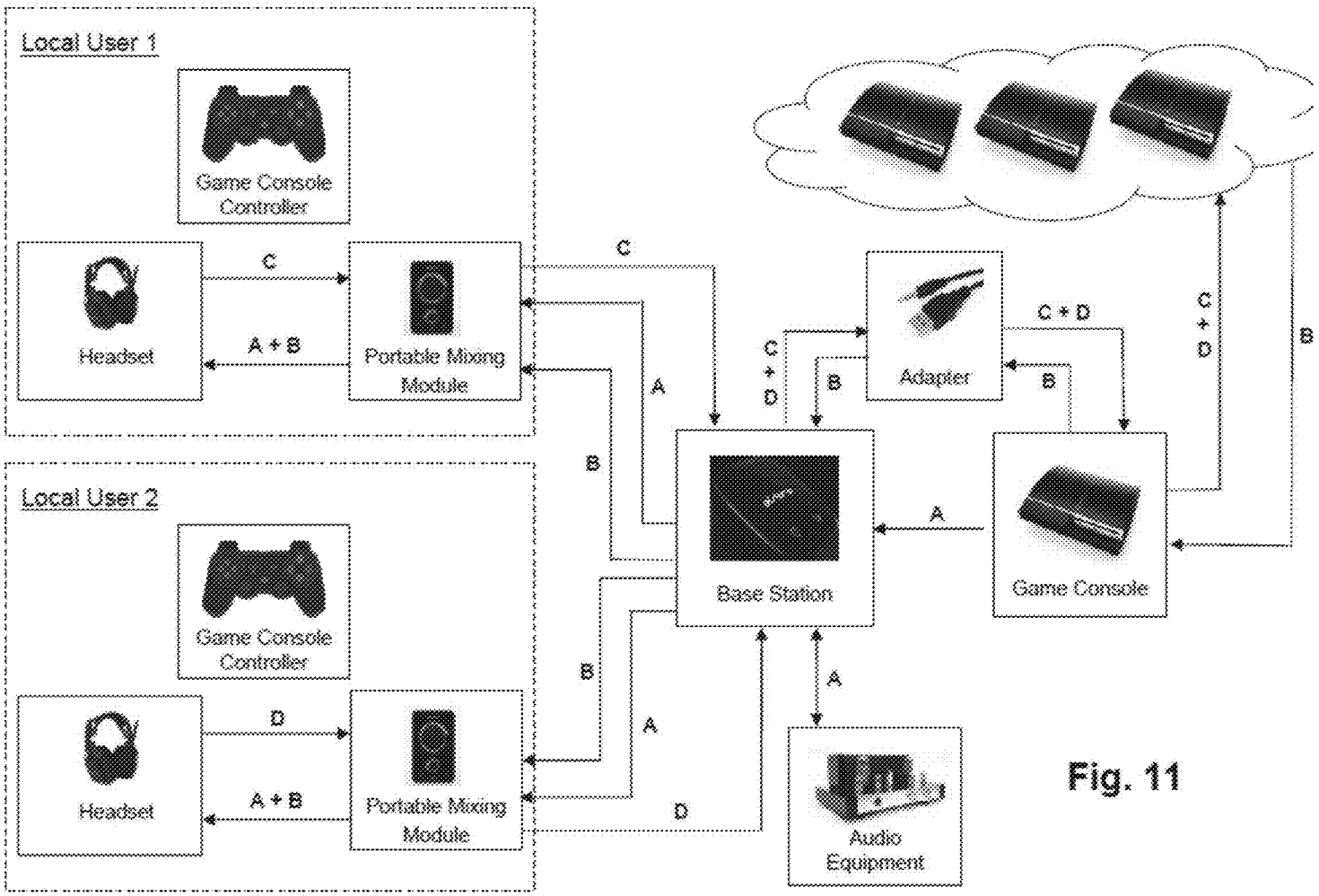
FIG. 11 is an exemplary schematic of a second multi-player which may incorporate the headset and audio profile controller system described herein.

As described in the '386 Patent, exemplary properties of the audio signals which may be controlled include, but are not limited to, balance and/or volume of a game audio and/or a network chat audio stream, as well as a base boost. Representative circuitry and programmable hardware components of the audio mixer are described and illustrated in the '386 Patent. Such a system, which includes at least the audio profile controller and the headphones, is particularly useful in gaming scenarios, including on-line and in-person tournament games. Depending on the particular use and/or environment, the headset and audio profile controller may communicate in a wired or wireless configuration with each other and/or with the audio source(s), e.g., game console, computer, personal device. In certain configurations, the audio profile controller may include a portable component in wired communication with the wireless headset and in wireless communication with a base station component. Descriptions of various configurations are found in the '386 Patent and are incorporated herein by reference. Exemplary schematics for particular multi-player game scenarios which may incorporate the headset and audio profile controller system described herein and implement the associated processes are shown in FIGS. 10 and 11.

But as discussed above, the in-person tournament games present a unique problem, wherein the external noise generated by spectators and other gamers in the venue can overwhelm the internal headset audio. In a preferred embodiment, a novel system includes (1) the stock open-back headset modified with the noise plates 110' and air-tight pads 102*a*', 102*b*' so as to effectively create a closed-back configuration (FIG. 9, CLOSED) which compromises the audio quality to the headset user in combination with (2) an add-on component, such as an audio profile controller or other the like, which sits between the audio source(s) and the headset and includes appropriate programmable hardware and/or software to correct or compensate for the negative audio effects of the closed-back configuration (FIG. 9, COMPENSATED). The audio profile controller may be an upgraded or next generation MixAmp™ which now includes the necessary programming to apply the compensation audio equalizer profile ("Compensation EQ") to the incoming audio signals, e.g., game audio, network chat audio stream or the mix thereof, in addition to facilitating the mixing control. Application of the Compensation EQ may be selectable by the user via a switch, button, toggle or the like on the audio profile controller. That is, when the physical changes are made to the user's headset, i.e., noise plates 110' and air-tight pads 102*a*', 102*b*' are added, the user can then manually select application of the Compensation EQ to equalize the audio profile from CLOSED to COMPENSATED as shown in FIG. 9.

Alternatively, the application of the Compensation EQ may be triggered by a sensor configuration which senses the physical changes or effects of the physical changes to the headset. By way of example, contact sensors at the magnetic couplings of the noise plates 110' and air-tight pads 102*a*', 102*b*' may trigger automatic application of the Compensation EQ by the audio profile controller when contact is confirmed at all points of contact. In another example, an external noise sensor within the headset may trigger automatic application of the Compensation EQ by the audio profile controller when the external noise sensor sensing a predetermined drop in external noise within the headset. In a still further example, application of the Compensation EQ by the audio profile controller may be voice activated with a particular command by the user received through the microphone of the headset. One skilled in the art recognizes the numerous ways that such sensing and detecting of the physical change to the headset or effects thereof may be communicated to the audio profile controller to trigger the application of the Compensation EQ responsive thereto. Similarly, when reverse physical changes are made, the sensors, detectors, and different voice activation may trigger removal of the Compensation EQ.

In yet a further embodiment, an add-on component is not required as the signal processing circuitry of the audio profile controller may be incorporated within the headset itself. Like the add-on audio profile controller, the signal processing circuitry may respond either manually, by a switch on the headset, or automatically, responsive to one or more of the detecting, sensing and/or voice commands as discussed above, in order to apply the Compensation EQ to the incoming signal when the stock open-back headset is physically modified to a closed-back configuration.

Accordingly, the system described herein and the associated processes of implementation solve numerous problems known in the art including how to compensate for audio distortion caused by impeding, albeit unintentionally, the air flow to the diaphragm drivers internal to the headset when air access is limited by the physical structure of the headset. The system and associated processes of the embodiments remedy the expensive requirement for different headsets depending on the type of use. A stock open-back headset can be transformed with minor physical changes and resulting audio distortion is corrected by application of predetermined Compensation EQ programmed into an audio profile controller connected to the headset.

While illustrative embodiments have been illustrated and described, it will be appreciated that various changes can be made therein without departing from the spirit and scope of the invention.

The invention claimed is:

1. An audio compensation system comprising:

a convertible headset including:

a left earphone configured to convert electrical energy into sound waves;

a right earphone configured to convert electrical energy into sound waves;

a first removable and interchangeable noise plate configured to selectively attach to one of the right and left earphones;

a second removable and interchangeable noise plate configured to selectively attach to the other of the right and left earphones;

a first removable air-tight pad inserted between a first of the left and right earphones and the first removable and interchangeable noise plate when the convertible headset is in a closed configuration;

a second removable air-tight pad inserted between a second of the left and right earphones and the second removable and interchangeable noise plate when the convertible headset is in the closed configuration;

wherein both the left earphone and the right earphone include components to facilitate mechanical and audible coupling with a removable microphone with or without one or both of the first and second noise plates and first and second removable air tight pads attached thereto, the components including a receiver component for receiving a connector portion of the removable microphone therein directly or after the connector portion passes through an aperture when the first noise plate is attached to one of the right and left earphones;

wherein the first and second noise plates and first and second removable air tight pads insulate a user of the headset from noise produced externally when one or both are attached to the convertible headset in the closed configuration; and an audio profile controller connected to the convertible headset and one or more audio sources, each audio source configured to provide one or more audio signals, the audio profile controller applying at least one audio equalizer profile to the audio signals to compensate for negative audio effects resulting from the closed configuration of the convertible headset by adjusting one or more properties of the one or more audio signals using the at least one equalizer profile.

2. The audio compensation system of claim 1, wherein the audio profile controller includes a manual selection component for facilitating selection of one or more audio equalizer profiles by the user.

3. The audio compensation system of claim 1, wherein the first noise plate includes the aperture configured to accept a connector portion of the removable microphone therethrough when the first noise plate is attached to one of the right and left earphones.

4. An audio compensation system comprising:

a convertible headset including:

a left earphone configured to convert electrical energy into sound waves;

a right earphone configured to convert electrical energy into sound waves;

a first removable and interchangeable noise plate configured to selectively attach to one of the right and left earphones;

a second removable and interchangeable noise plate configured to selectively attach to the other of the right and left earphones;

a first removable air-tight pad inserted between a first of the left and right earphones and the first removable and interchangeable noise plate when the convertible headset is in a closed configuration;

a second removable air-tight pad inserted between a second of the left and right earphones and the second removable and interchangeable noise plate when the convertible headset is in the closed configuration;

wherein both the left earphone and the right earphone include components to facilitate mechanical and audible coupling with a removable microphone with or without one or both of the first and second noise plates and first and second removable air tight pads attached thereto, the components including a receiver component for receiving a connector portion of the removable microphone therein directly or after the connector portion passes through an aperture when the first noise plate is attached to one of the right and left earphones;

wherein the first and second noise plates and first and second removable air tight pads insulate a user of the headset from noise produced externally when one or both are attached to the convertible headset in the closed configuration; and an audio profile controller connected to the convertible headset and one or more audio sources, the audio profile controller including one or more audio equalizer profiles programmed therein to compensate for negative audio effects resulting from the closed configuration of the convertible headset, wherein the audio profile controller is responsive to a sensor component for automatically selecting one or more audio equalizer profiles.

5. The audio compensation system of claim 4, wherein the sensor component automatically selects from the one or more audio equalizer profiles when the sensor component senses a physical configuration change to the convertible headset.

6. The audio compensation system of claim 5, wherein the physical configuration change includes attachment of the first and second removable and interchangeable noise plates to the right and left earphones.

7. The audio compensation system of claim 4, wherein the sensor component automatically selects from the one or more audio equalizer profiles when the sensor component senses an audio configuration change within the convertible headset.

8. A convertible headset comprising:

an assembly of parts configured to convert electrical energy into sound waves, the assembly including earphones and removable and interchangeable components for physically altering the convertible headset from an open to a closed configuration, wherein altering the convertible headset from an open to closed configuration produces negative audio effects for a user of the convertible headset;

the assembly of parts further including an audio profile controller connected to the convertible headset and one or more audio sources, each audio source configured to provide one or more audio signals, the audio profile controller applying at least one audio equalizer profile to the audio signals to compensate for the negative audio effects by adjusting one or more properties of the one or more audio signals using the at least one audio equalizer profile.

9. The convertible headset of claim 8, wherein the audio profile controller includes a manual selection component for facilitating selection of one or more audio equalizer profiles by the user.

10. The convertible headset of claim 8, wherein the removable and interchangeable components include: a noise plate, an air-tight pad and a microphone.

11. A convertible headset comprising:

an assembly of parts configured to convert electrical energy into sound waves, the assembly including earphones and removable and interchangeable components for physically altering the convertible headset from an open to a closed configuration, wherein altering the convertible headset from an open to closed configuration produces negative audio effects for a user of the convertible headset;

the assembly of parts further including an audio profile controller connected to the convertible headset and one or more audio sources, the audio profile controller including one or more audio equalizer profiles programmed therein to compensate for the negative audio effects, wherein the audio profile controller is responsive to a sensor component for automatically selecting one or more audio equalizer profiles.

12. The convertible headset of claim 11, wherein the sensor component automatically selects from the one or more audio equalizer profiles when the sensor component senses a physical configuration change to the convertible headset.

13. The convertible headset of claim 12, wherein the physical configuration change includes attachment of the removable and interchangeable components to the earphones.

14. The convertible headset of claim 10, wherein a noise plate includes an aperture configured to guide a connector portion of a microphone therethrough to physically connect with an audio circuitry receiver component of the earphone and a magnetic component for removably attaching the noise plate to the earphone, wherein the noise plate insulates a wearer of the convertible headset from noise produced external from the audio circuitry when attached to the earphone; and further wherein the assembly of parts converts electrical energy into sound waves with or without the noise plate included therein.

15. The convertible headset of claim 11, wherein the sensor component automatically selects from the one or more audio equalizer profiles when the sensor component senses an audio configuration change within the convertible headset.

16. A convertible headset for facilitating communication from and to a user of the convertible headset during a multiplayer game and optimizing game audio quality comprising:

a left earphone including left audio circuitry, a removable left noise plate and a removable left air-tight pad;

a right earphone including right audio circuitry, a removable right noise plate and a removable right air-tight pad;

a microphone attached to one of the left and right earphones for generating internal communications;

wherein the left noise plate, left air-tight pad, the right noise plate and the right air-tight pad isolate internal communications between the user and other players in the multiplayer game by insulating the user of the convertible headset from external communications when the left noise plate, left air-tight pad, the right noise plate and the right air-tight pad are attached to the convertible headset in a closed headset configuration;

further wherein the user can remove the left noise plate, left air-tight pad, the right noise plate and the right air-tight pad in order to facilitate receipt of internal and external communications in an open headset configuration; and an audio profile controller connected to the convertible headset and receiving therein one or more audio signals, including a game audio signal, the audio profile controller applying at least one audio equalizer profile to the audio signals to compensate for negative audio effects experienced by the user resulting from the closed headset configuration of the convertible headset by adjusting one or more properties of an audio signal provided by each of the one or more audio signals using the at least one audio equalizer profile.

17. The convertible headset of claim 16, wherein the audio profile controller includes a manual selection component for facilitating selection of one or more audio equalizer profiles by the user.

18. The convertible headset of claim 16, the left and right noise plates each including an aperture configured to guide a connector portion of the microphone therethrough to physically connect with the left or right audio circuitry of the left or right earphone.

19. A convertible headset for facilitating communication from and to a user of the convertible headset during a multiplayer game and optimizing game audio quality comprising:

a left earphone including left audio circuitry, a removable left noise plate and a removable left air-tight pad;

a right earphone including right audio circuitry, a removable right noise plate and a removable left air-tight pad;

a microphone attached to one of the left and right earphones for generating internal communications;

wherein the left noise plate, left air-tight pad, the right noise plate and the right air-tight pad isolate internal communications between the user and other players in the multiplayer game by insulating the user of the convertible headset from external communications when the left noise plate, left air-tight pad, the right noise plate and the right air-tight pad are attached to the convertible headset in a closed headset configuration;

further wherein the user can remove the left noise plate, left air-tight pad, the right noise plate and the right air-tight pad in order to facilitate receipt of internal and external communications in an open headset configuration; and an audio profile controller connected to the convertible headset and receiving therein one or more audio signals, including a game audio signal, the audio profile controller including one or more audio equalizer profiles programmed therein to compensate for negative audio effects experiences by the user resulting from the closed headset configuration of the convertible headset, wherein the audio profile controller is responsive to a sensor component for automatically selecting one or more audio equalizer profiles.

20. The convertible headset of claim 19, wherein the sensor component automatically selects from the one or more audio equalizer profiles when the sensor component senses a physical configuration change to the convertible headset.

21. The convertible headset of claim 20, wherein the physical configuration change includes attachment of the removable and interchangeable components to the earphones.

22. The convertible headset of claim 19, wherein the sensor component automatically selects from the one or more audio equalizer profiles when the sensor component senses an audio configuration change within the convertible headset.

* * * * *